US005181764A

United States Patent [19]

Wiener

[11] Patent Number: 5,181,764

[45] Date of Patent: Jan. 26, 1993

[54] CHAIR AND SEAT APPARATUS, AND METHODS OF CONSTRUCTING AND UTILIZING SAME

[76] Inventor: Hattie Wiener, 322 W. 57th St., New York, N.Y. 10019

[21] Appl. No.: 769,364

[22] Filed: Oct. 1, 1991

Related U.S. Application Data

[63] Continuation-in-part of Ser. No. 558,159, Jul. 25, 1990, Pat. No. 5,052,755.

[51] Int. Cl.[5] ..... A47C 7/02

[52] U.S. Cl. ..... 297/452; 297/460; 297/284.1; 297/284.11

[58] Field of Search ..... 297/201, 202, 312, 459, 297/284 H, 284 R, 460

[56] References Cited

U.S. PATENT DOCUMENTS

| | | | |
|---|---|---|---|
| 135,973 | 2/1873 | Doremus | 297/312 X |
| 1,527,754 | 2/1925 | Simon | 297/436 X |
| 4,399,572 | 8/1983 | Johansson | 297/312 X |
| 4,911,502 | 3/1990 | Gorman | 297/284 CX |
| 5,018,790 | 5/1991 | Jay | 297/459 X |
| 5,024,485 | 6/1991 | Berg et al. | 297/312 |
| 5,052,755 | 10/1991 | Wiener | 297/452 |

*Primary Examiner*—Peter A. Aschenbrenner
*Attorney, Agent, or Firm*—Irving M. Weiner; Pamela S. Burt; Joseph P. Carrier

[57] ABSTRACT

A pressure and fatigue reducing seat provided as part of a full chair, or alternatively as part of a portable seat apparatus, and adapted to support a user's body so as to eliminate undesirable pressure to parts of the user's body including the spine. The seat portion cooperates with a back support portion to normally and comfortably maintain an erect sitting posture. The seat portion includes a pair of spaced-apart members for supporting the user's buttocks, and an elongated member for supporting the back of the user's thighs. The back support portion includes a pair of lower support members which contact the user's back at spaced-apart points in the posterior pelvic area, and may also include a pair of upper support members which contact the user's back at spaced apart points in the thoracic area. The portable seat apparatus may be placed on any existing chair or seat, and may be conveniently transported and stored.

20 Claims, 2 Drawing Sheets

CHAIR AND SEAT APPARATUS, AND METHODS OF CONSTRUCTING AND UTILIZING SAME

This is a continuation-in-part of application Ser. No. 558,159 filed Jul. 25, 1990 which issued as U.S. Pat. No. 5,052,755 on Oct. 1, 1991.

BACKGROUND OF THE INVENTION

1. Field of the Invention

The present invention relates generally to a chair, as well as a separate and independent seat apparatus, each having a specially-designed seat portion providing particular support portions for a user's body. More particularly, the invention relates to both a complete chair, and a portable seat apparatus which may be positioned on an existing chair, seat or bench, each incorporating a seat portion which provides support to only particular portions of the user's body, thereby increasing comfort, blood circulation and ventilation, while eliminating back problems associated with conventional seat constructions, and improving sitting posture. Both the portable seat apparatus and the chair preferably include back supporting portions for exerting pressure at particular points on the user's back, the back supporting portions cooperating with the specially-designed seat portion to ensure that a person sitting on the chair will maintain an erect sitting posture.

2. Description of Relevant Art

Conventional seat constructions, such as those found in chairs, car seats, airline seats, benches, etc., comprise a generally flat horizontal surface providing indiscriminate support to the user's lower spine, buttocks and thighs. Such indiscriminate support of these areas of the user's body causes undesirable pressure to the lower spine and other areas of the body, leading to fatigue, lower back pain, poor sitting posture and a host of other related problems.

Another disadvantage of conventional chair constructions is that they typically permit and even encourage a user to sit in a slouched or non-erect position. Because an ongoing conscious effort is required to maintain an erect sitting posture, the user is likely to spend more time in a slouched or non-erect sitting posture than an erect one. For the vast number of people who spend the majority of their waking hours in a seated position, conventional chairs fail to offer the desirable advantage of maintaining an erect sitting posture without requiring a conscious effort to do so.

The chair disclosed in U.S. Pat. No. 5,052,755 overcomes many of the foregoing difficulties encountered with conventional chair constructions by supporting a user's body in a way which naturally encourages an erect sitting posture. The novel back support and seat portions of the chair disclosed in such co-pending application cooperate to maintain the user's body in an erect and healthy sitting posture without requiring any conscious effort on the user's part to monitor and/or properly orient his or her body.

The present invention overcomes further difficulties attendant conventional chair constructions by providing a novel seat design which supports the user's buttocks and thighs only at particular portions. The novel seat design may be incorporated in a full chair construction, or alternatively may form part of a portable seat apparatus which may be positioned on existing chairs, seats or benches. Both the full chair and the portable seat apparatus preferably also include the novel features disclosed in applicant's aforesaid co-pending application so as to provide an overall design which maximizes comfort, minimizes undesirable stress to various body portions, and encourages an erect and healthy sitting posture.

SUMMARY OF THE INVENTION

The present invention provides a full chair, or a portable seat apparatus, adapted to support a user's body so as to eliminate undesirable pressure to parts of the user's body including the spine, and/or to improve sitting posture. To this end, the chair and the portable seat apparatus each include a seat portion supported on a frame, the seat portion including first means for independently supporting right and left buttock portions of the user's body, and further including second means, spaced from said first means, for supporting back portions of the user's thighs.

In preferred embodiments, the first support means of the seat portion comprises a pair of spaced-apart buttocks support members, and the second support means of the seat portion comprises an elongated thigh support member adapted to support back portions of each of the user's thighs.

In the full chair embodiment of the invention, the chair frame supports thereon the seat portion and a back support portion which cooperates with the seat portion so as to control sitting posture. The back support portion is mounted on the frame substantially rearwardly of the seat portion, the back support portion including third means for independently supporting two separate portions of a user's back, on either side of the spine, in the posterior pelvic area, and further including fourth means for independently supporting two separate portions of a user's back, on either side of the spine, in the thoracic area. The third support means preferably comprises a pair of spaced-apart lower back support members, and the fourth support means preferably comprises a pair of spaced-apart upper back support members. Preferably, the upper back support members are arranged in a vertical plane which is closer to the front of the chair than the vertical plane containing the lower back support members. The seat portion preferably has a front to back dimension which is sufficiently small that a user seated in the chair will sense that he/she is sliding forwardly off the chair if he/she shifts to a slouched or non-erect position.

The portable seat apparatus embodiment of the invention, which incorporates the same novel seat portion as the full chair embodiment, may also be provided with a back support portion which cooperates with the seat portion so as to control sitting posture. The back support portion may be substantially the same as that described above for the full chair embodiment, i.e., including upper and lower pairs of back support members. Alternatively, the portable seat apparatus may include only lower spaced-apart back support members, or a single elongated lower back support member which supports the posterior pelvic area of the user's body. To facilitate transportation and storage of the portable seat apparatus, various frame portions thereof may be provided with hinge means which permit the apparatus to be folded into a compact unit.

A principal object of the invention is to provide a novel seat portion, which may be incorporated either in a full chair or in a portable seat apparatus, which supports a user's body so as to eliminate undesirable pressure to parts of the user's body including the spine. The portable seat apparatus may be used in conjunction with existing chairs, seats or benches merely by placing the apparatus thereon.

Another object of the invention is to provide a chair and portable seat apparatus which promotes a healthy sitting posture by naturally supporting the user's body in an erect sitting position.

A further object of the invention is to provide a chair and portable seat apparatus of simple construction which is aesthetically pleasing, and which at the same time reduces undesirable stress to the user's body and promotes a healthy erect sitting posture so as to eliminate back strain.

The above and further objects, details and advantages of the invention will become apparent from the following detailed description, when read in conjunction with the accompanying drawings.

DETAILED DESCRIPTION OF PREFERRED EMBODIMENTS

Figure 1:
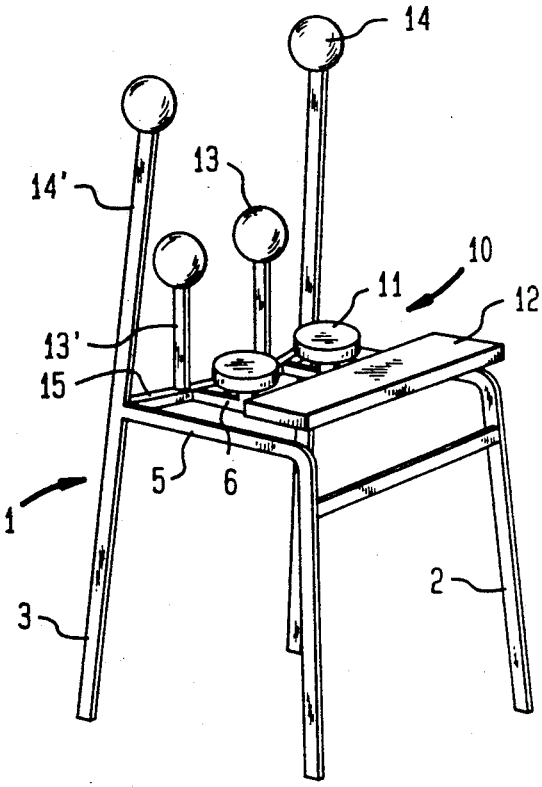
FIG. 1 is a perspective view of a first embodiment of the invention, in the form of a full chair provided with the novel seat portion according to the invention.
Figure 2:
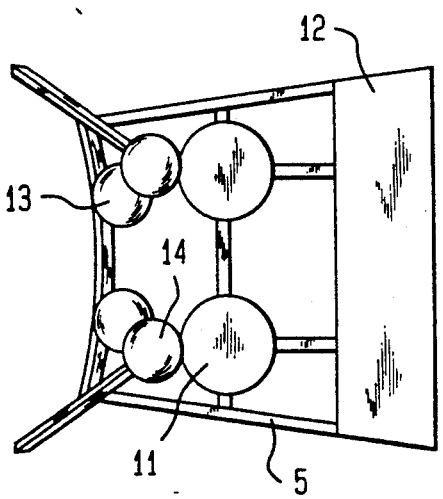
FIG. 2 is a top plan view of the chair of FIG. 1.
Figure 3:
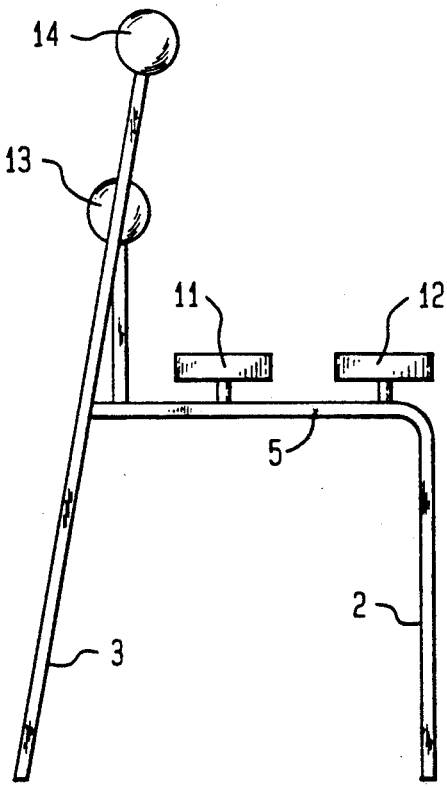
FIG. 3 is a side elevational view of the chair of FIG. 1.

With reference to FIGS. 1–3, a full chair according to the first embodiment of the invention includes a frame indicated generally by reference numeral 1. The frame 1 includes a pair of front legs 2 and a pair of rear legs 3 for supporting the chair on a floor or other horizontal surface. The frame 1 is preferably constructed of sturdy rigid material, such as for example, metal. If desired, a pair of cross-supports 4 may extend between the respective legs 2, 3, a front cross-support may extend between the respective front legs 2, and a rear cross-support may extend between the rear legs 3.

The construction of the legs 2, 3 may be modified as desired, and is not limited to the four-leg construction shown. For example, legs 2, 3 may be replaced by a swivel pedestal base so as to define an office or secretarial chair, or a bar stool.

Each of the front legs 2 of the chair is bent at substantially a right angle to define a substantially horizontal seat support frame portion 5. Additional seat support frame portions 6, and/or other seat-supporting frame portions, may be provided as needed to afford necessary support for the novel seat portion, as described below. Generally, it is to be understood that the construction of frame 1 may be modified as desired, without departing from the spirit or scope of the invention.

The novel seat portion 10 of the invention is adapted to support the user's body in a manner which eliminates undesirable pressure and stress to parts of the user's body, and particularly the spine, while providing a comfortable and anatomically designed seat support. To this end, the seat portion 10 includes a pair of spaced-apart rear members 11 for independently supporting areas of the user's right and left buttocks. Arranged forwardly of the buttocks-supporting members 11 is an elongated member 12 for supporting the back of the user's thighs. Although the members 11 are shown as having a generally round shape, and the member 12 is shown as having a generally elongated rectangular shape, it will be understood that the shape of members 11 and 12 may be modified as desired, as long as they provide support to the desired body areas.

In a preferred embodiment, the diameter of each of the members 11 is approximately four inches, and members 11 are spaced such that a distance of 7 ¼ inches separates their centers. The member 12 is approximately sixteen inches long (i.e., in the width direction of the chair) and approximately four inches wide (i.e., in the front to rear direction of the chair). The rear edge of member 12 is separated from the forwardmost edges of members 11 by a distance of approximately 2 ¾ inches. The overall front to rear dimension of the seat portion, i.e., from the frontmost edge of member 12 to the rearmost edges of members 11 is approximately 10 ¾ inches.

As shown in FIGS. 1–3, the members 11 and 12 are arranged such that the upper substantially horizontal surface portions thereof are substantially co-planar. It is to be understood, however, that the arrangement of members 11 and 12 is not limited to the configuration shown, and if desired the members 11 and 12 may be provided with either concave, convex or other configurations of the upper surfaces thereof. The members 11 and 12 may be fabricated of any suitable material, although preferably at least some amount of padding is provided at the upper portions thereof. It is also preferable that at least the upper surfaces of members 11, 12 be fabricated of a friction enhancing material such as rubber or the like, to prevent sliding of the user's body relative thereto and to stimulate circulation.

The back support portion of the chair is defined by lower means for independently supporting two separate portions of a user's back on either side of the spine in the posterior pelvic area, and upper means for independently supporting two separate portions of a user's back on either side of the spine in the thoracic area. The lower support means takes the form of a pair of spaced-apart spherical members or balls 13, and the upper support means takes the form of a pair of spaced-apart spherical members or balls 14.

The lower balls 13 are supported on upwardly extending frame portions 13', while the upper balls 14 are supported on upwardly extending frame portions 14'. A rear frame cross-member 15 is connected to the rear ends of frame members 6, and near the intersection of frame members 3, 5, so as to support frame portions 13'. The frame portions 14' for supporting upper balls 14 may desirably, but not necessarily, comprise integral upward extensions of rear legs 3 as shown.

Figure 4:
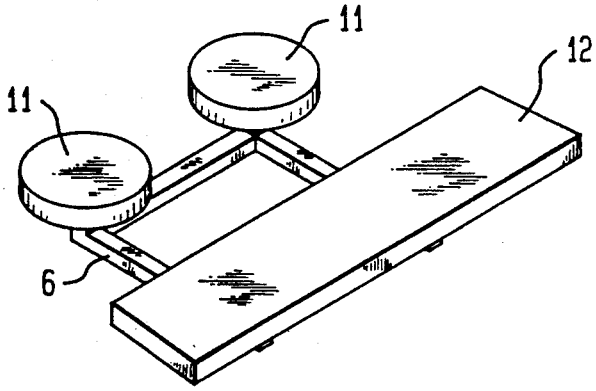
FIG. 4 is a perspective view of a portable seat apparatus according to a second embodiment of the invention.

With reference to FIG. 4, the upper balls 14 are spaced apart a greater distance than the lower balls 13 such that both balls 13 are disposed inwardly of balls 14 in the widthwise direction of the chair. The upper balls 14 are also disposed in a vertical plane which is very slightly closer to the front of the chair than the vertical plane containing lower balls 13 (i.e., the upper balls 14 and lower balls 13 are almost co-planar), as shown in FIG. 4. To this end, the frame legs or members 3 are inclined somewhat towards the front of the chair from their bottoms to their tops. It is further contemplated that the orientation of the lower balls 13 and upper balls 14 may be adjustable by the user in the front-to-back, side-to-side, and up-and-down directions, so that the user can adjust the relative positions of same to conform comfortably to the user's body in a sitting posture.

The lower balls 13 are elevated a predetermined distance above the seat portion 10 so as to contact the user's back at spaced-apart points below the waist in the posterior pelvic area, while the upper balls 14 are elevated a predetermined distance so as to contact the user's back at spaced-apart points above the waist in the thoracic area. To this end, the supports 13' support lower balls 13 at a distance approximately 4 inches above the seat portion, while the supports 14' support upper balls 14 at a distance approximately 14.5 inches above the seat portion, or approximately 32 inches from the floor. Preferably, the diameter of each of the balls 13 and 14 is approximately 3 inches.

The balls 13, 14 may be formed of solid rubber, or may be formed of a sphere made of metal or other material with an outer cushioned covering. The lower and upper balls 13, 14 may be formed according to either construction. Other constructions for the back support members are also contemplated, such as pad members which will be described hereinbelow with respect to the portable seat apparatus embodiment of the invention.

The seat portion 10 has a front to back dimension which is sufficiently small, as described above, that a user seated in the chair will sense that he/she is sliding forwardly off the seat if he/she sits in a slouched or non-erect position. When seated properly erect, the user will be comfortably accommodated by the seat portion 10.

With the chair construction as shown and described, the seat portion 10 will comfortably support the user's buttocks and thighs without exerting undesirable pressure to other parts of the body, and particularly the spine. Further, the user's body will be naturally and comfortably supported in an erect sitting posture due to the cooperating seat and back support portions. Unlike conventional chairs, the chair according to the invention virtually eliminates undesirable pressure and stress to the user's back, and promotes an erect sitting posture. The user need not consciously maintain an erect posture since the chair according to the invention will naturally encourage same.

The design of the chair in accordance with the invention naturally supports the user's body in an erect sitting posture. The spaced apart back supports 13, 14 are arranged to contact the user's back at two points below the waist and two points above the waist, with the upper supports 14 being arranged closer to the front of the chair than lower supports 13. This arrangement of supports 13, 14 provides for application of pressure to the user's back in a manner which naturally maintains an erect sitting posture.

When the user is properly positioned with his/her back supported below and above the waist by balls 13 and 14, respectively, the seat 10 will comfortably support him/her without any pressure to the lower spine area. Should the user shift to a slouched or nonerect position, the relatively shallow seat 10 will fail to provide comfortable support, causing the user to sense that he/she is sliding off the chair. The construction of seat 10 thus cooperates with back support balls 12 and 14 to naturally maintain an erect sitting posture to thereby reduce strain to the back and other body parts.

With reference to FIGS. 4–9, there is depicted a portable seat apparatus in accordance with a second main embodiment of the invention.

The portable seat apparatus is shown in its basic form in FIG. 4, without the back support portion to be described below. As shown, the seat portion of the portable seat apparatus is substantially the same as seat portion 10 described above with respect to the full chair embodiment of the invention. It will be understood that the basic construction of the seat portion, including the construction of support members 11 and 12, the spacing therebetween and the various dimensions thereof, are substantially identical to those described above with respect to seat portion 10.

The portable seat apparatus of FIGS. 4–9 is adapted for use with existing chairs, seats, benches and the like. The apparatus may be conveniently transported by the user, and simply placed on an existing chair or seat so as to provide the user with the novel features of the invention. The portable seat apparatus may be used in a wide variety of applications, such as by positioning same on car seats, airplane seats, and the like.

Figure 5:
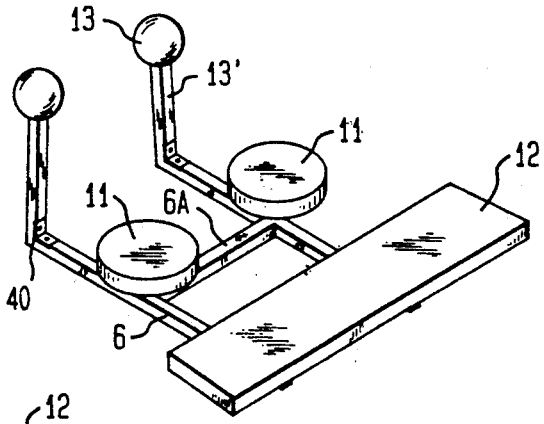
FIG. 5 is a perspective view of a portable seat apparatus according to the invention, provided with ball-shaped lower back support members.
Figure 6:
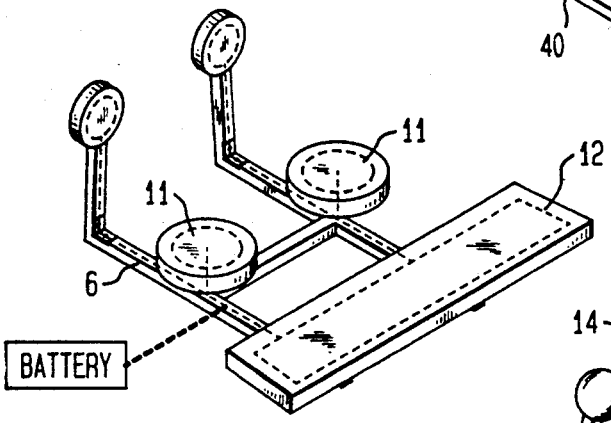
FIG. 6 is a perspective view of a portable seat apparatus according to the invention, provided with lower back support pads.

With reference to FIG. 5, the portable seat apparatus may be provided with the lower support balls 13 for independently supporting the posterior pelvic area on either side of the user's spine, as described above with reference to the full chair embodiment. The frame support members 13' for support balls 13 extend upwardly from rear extensions of seat frame support members 6, and have generally the same dimensions, configuration and construction described above with respect to the full chair embodiment. For ease of transportation and storage, the frame supports 13' may be connected by hinges 40 to frame supports 6, as shown (FIGS. 5 and 6). When the frame supports 13' with balls 13 are folded downwardly, the user is provided with a compact structure which may be conveniently stored and transported.

It is contemplated that various modifications may be made in the portable seat apparatus to render same even more compact for convenient storage and transportation. For example, another hinged connection may be provided in the center of frame support 6A and the member 12 may be hinged at its center, so that the apparatus may be folded such that members 11 and 11 substantially contact each other. Further, the frame assembly including frame supports 6, 6A and 13', and the connections between the frame supports and the members 11, 12, maybe provided with interlocking means so that the various parts of the apparatus may be conveniently assembled and disassembled. If desired, the members 11 and 12 may also be inflatable. These contemplated modifications apply with equal vigor to the various embodiments shown in FIGS. 5–9.

With reference to FIG. 6, the portable seat apparatus is substantially identical to that described with respect to FIG. 5, except that lower back support balls 13 are replaced by lower back support pads 23. The back support pads 23 are shown as substantially disc-shaped, however, other desired shapes may alternatively be employed. The lower back support pads 23 are dimensioned and arranged substantially as described above with respect to lower back support balls 13, to thus provide independent support to posterior pelvic areas on either side of the user's spine.

Figure 7:
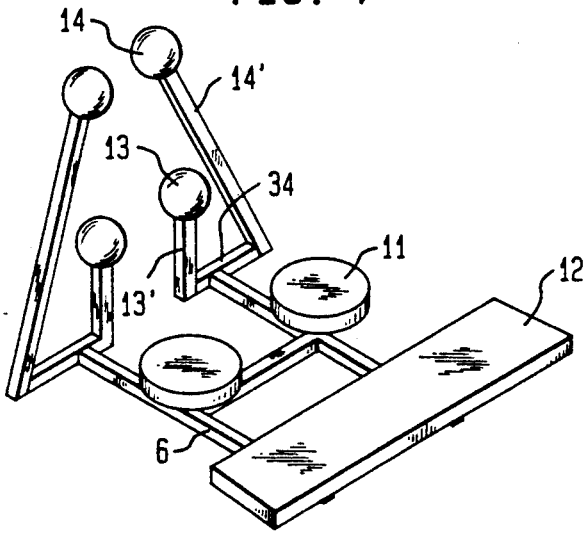
FIG. 7 is a perspective view of a portable seat apparatus according to the invention, provided with ball-shaped upper and lower back support members.

As shown in FIG. 7, the portable seat apparatus may be provided with the full back support structure including both lower back support balls 13 and upper back support balls 14 as described above with respect to the full chair embodiment of the invention. To this end, a frame support 34 extends between the lower ends of frame supports 13' and 14' and is connected to the rear end of frame support 6. The relative spacing and dimensions of lower and upper support balls 13 are generally the same as described above, with upper balls 14 being disposed in a vertical plane which is slightly closer to the front of the apparatus than the vertical plane containing lower balls 13. It is further contemplated that the orientation of the lower balls 13 and upper balls 14 may be adjustable by the user in the front-to-back, side-to-side and up-and-down directions, so that the user can adjust the relative positions of same to conform comfortably to the user's body in a sitting posture.

Similar to the embodiments of FIGS. 5 and 6, the frame supports 13' and 14' of FIG. 7 may be connected by hinges to frame support 34, or may be otherwise pivotally connected to permit folding to a collapsed condition, or rigid fixing in an erected state.

Figure 8:
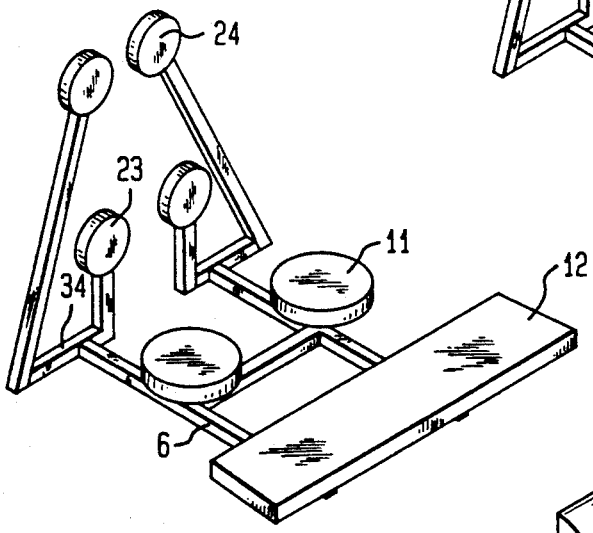
FIG. 8 is a perspective view of a portable seat apparatus according to the invention, provided with upper and lower back support pads.

In FIG. 8 is shown an embodiment of the portable seat apparatus which is substantially the same as that in FIG. 7, except that the lower and upper balls 13 and 14 are replaced by lower and upper pads 23 and 24 which are comparable to pads 23 described with reference to FIG. 6.

Figure 9:
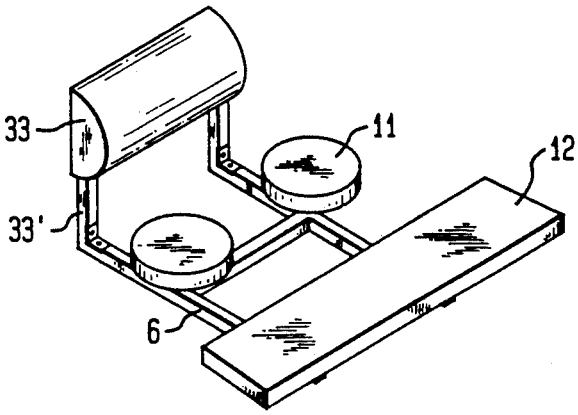
FIG. 9 is a perspective view of a portable seat apparatus according to the invention, provided with an elongated lower back support member.

FIG. 9 shows yet another embodiment of the portable seat apparatus of the invention in which the lower support balls 13 or pads 23 are replaced by a single elongated lower back support 33. As shown, the lower back support 33 is provided with an arcuate front surface for contact with the posterior pelvic area of the user's back. The support 33 may be cushioned as desired, and has a length substantially equal to the distance separating the outermost edges of members 11, as shown. The support 33 may preferably be supported by frame supports 33' so as to be elevated approximately four inches above the seat portion, which height may be adjustable if desired. As in the preceding embodiments, frame supports 33' may be provided with hinged connections which permit the support 33 to be folded downwardly to define a compact structure for carrying or storing.

The portable seat apparatus as described with reference to FIGS. 5–9, as with the full chair embodiment of the invention, provides the user with a comfortable, stress-reducing, and posture-enhancing seat. Because the portable seat apparatus is compact and lightweight, it may be easily carried from place to place to permit the user to adapt existing chairs and seats so as to obtain the novel features of the invention. The portable seat apparatus may be easily positioned on any existing seat, such as a car seat or airplane seat, and may be conveniently transported so that the user may use same in conjunction with any number of seats he/she may sit in on any given day.

By positioning the portable seat apparatus on an existing chair or seat, the existing chair or seat is transformed into one which essentially eliminates pressure or stress to the user's spine by providing precise anatomical support only at desired points, while at the same time encouraging a proper sitting posture. As such, the portable seat apparatus serves to virtually eliminate back strain and other problems caused by conventional chairs.

In connection with all of the various embodiments of the full chair and portable seat apparatus described above, the invention contemplates the provision of vibrating means and power supply means therefor. Any suitable known vibrating means may be employed which will impart a vibrating movement to each of the support members, including those of the seat portion and the back supports. Such vibrating means are shown in dashed line at 40 in FIG. 6, together with electrical lines shown in dashed line within the various frame members. The battery pack (and associated switch means) may be provided externally to the apparatus as shown in FIG. 6, to permit selective connection by the user, or alternatively may be integrally connected with the apparatus. The user may thus be provided with a therapeutic massaging of body portions in contact with the support members.

While there have been disclosed what are at present considered to be the preferred embodiments of the invention, it will be understood that various modifications may be made therein without departing from the spirit or scope of the invention. The present embodiments are therefore to be understood as illustrative, and not restrictive. The scope of the invention is indicated by the appended claims.

I claim:

1. A chair adapted to support a user's body so as to eliminate undesirable pressure to parts of the user's body including the spine, comprising:

a frame including means for supporting the chair on a horizontal surface;

a seat portion supported on said frame;

said seat portion including a pair of spaced-apart buttocks support members for independently supporting right and left buttock portions of the user's body, without any body-contacting portion therebetween;

said seat portion further including an elongated thigh support member adapted to support back portions of each of the user's thighs;

said elongated thigh support member having the longitudinal axis thereof extending across the width of said seat portion so as to define a front part of said seat portion;

said spaced-apart buttocks support members being rearwardly spaced from said thigh support member so as to define a separate and independent back part of said seat portion;

each of said buttocks support members and said thigh support member being separately and independently supported on separate portions of said frame, without any body-contacting portions therebetween; and the combined width dimensions of said buttocks support members being substantially less than the width of said front part of said seat portion defined by said thigh support member.

2. A chair adapted to support a user's body so as to eliminate undesirable pressure to parts of the user's body including the spine, comprising:

a frame including means for supporting the chair on a horizontal surface;

a seat portion supported on said frame;

said seat portion including first means for independently supporting right and left buttock portions of the user's body;

said seat portion further including second means, spaced from said first means, for supporting back portions of the user's thighs;

a back support portion mounted on said frame substantially rearwardly of said seat portion;

said back support portion including third means for independently supporting two separate portions of a user's back, on either side of the spine, in the posterior pelvic area;

said back support portion further including fourth means for independently supporting two separate portions of a user's back, on either side of the spine, in the thoracic area; and said back support portion cooperating with said seat portion so as to control sitting posture.

3. A chair according to claim 1, wherein:

said pair of spaced-apart buttocks support members are each substantially disc-shaped; and said front part of said seat portion defined by said elongated thigh support member is substantially flat and has a width dimension which is substantially double the combined diameter dimensions of said disc-shaped buttocks support members.

4. A chair according to claim 3, wherein:

upper surface portions of said buttocks support members are substantially coplanar with upper surface portions of said thigh support member.

5. A chair according to claim 2, wherein:

said third support means comprises a pair of spaced-apart lower back support members, and said fourth support means comprises a pair of spaced-apart upper back support members; and said upper back support members are arranged in a vertical plane which is closer to the front of said chair than the vertical plane containing said lower back support members.

6. A chair according to claim 5, wherein:

said first support means comprises a pair of spaced-apart buttocks support members; and said second support means comprises an elongated thigh support member adapted to support back portions of each of the user's thighs; and said seat portion has a front to back dimension, extending from the rear side of said buttocks support members to the front side of said thigh support member, which is sufficiently small that a user seated in said chair will sense that he/she is sliding forwardly off said chair unless he/she sits in a position in which his/her back is in contact with said upper and lower back support members.

7. A portable seat apparatus adapted to support a user's body so as to eliminate undesirable pressure to parts of the user's body including the spine, said seat apparatus being adapted to be disposed on a conventional chair or seat, comprising:

a support frame adapted to rest on a conventional chair or seat;

a seat portion mounted to an upper side of said support frame;

said seat portion including a pair of spaced-apart buttocks support members for independently supporting right and left buttock portions of the user's body, without any body-contacting portion therebetween;

said seat portion further including an elongated thigh support member adapted to support back portions of each of the user's thighs;

said elongated thigh support member having the longitudinal axis thereof extending across the width of said seat portion so as to define a front part of said seat portion;

said spaced-apart buttocks support members being rearwardly spaced from said thigh support member so as to define a separate and independent back part of said seat portion;

each of said buttocks support members and said thigh support member being separately and independently supported on separate support portions of said frame, without any body-contacting portions therebetween; and the combined width dimensions of said buttocks support members being substantially less than the width of said front part of said seat portion defined by said thigh support member.

8. A portable seat apparatus according to claim 7, wherein:

said pair of spaced-apart buttocks support members are each substantially disc-shaped; and said front part of said seat portion defined by said elongated thigh support member is substantially flat and has a width dimension which is substantially double the combined diameter dimensions of said dis-shaped buttocks support members.

9. A portable seat apparatus according to claim 7, comprising:

a back support portion mounted on said frame substantially rearwardly of said seat portion; and said back support portion including third means for independently supporting two separate portions of a user's back, on either side of the spine, in the posterior pelvic area.

10. A portable seat apparatus according to claim 9, wherein:

said third support means comprises a pair of spaced-apart lower back support members; and said lower back support members are substantially spherical.

11. A portable seat apparatus according to claim 9, wherein:

said third support means comprises a pair of spaced-apart lower back support members; and said lower back support members are substantially disc-shaped.

12. A portable seat apparatus according to claim 7, further comprising:

a back support portion mounted on said frame substantially rearwardly of said seat portion;

said back support portion including third means for supporting a user's back in the posterior pelvic area; and said third support means comprising an elongated support pad.

13. A portable seat apparatus according to claim 9, wherein:

the portion of said frame supporting said back support portion is hingedly connected to the portion of said frame supporting said seat portion.

14. A portable seat apparatus according to claim 9, wherein:

said back support portion further comprises fourth means for independently supporting two separate portions of a user's back, on either side of the spine, in the thoracic area; and said seat portion has a front to back dimension which is sufficiently small that a user seated in said apparatus will sense that he/she is sliding forwardly off said apparatus unless he/she sits in a position in which his/her back in contact with said third and fourth means of said back support portion, such that said back support portion cooperates with said seat portion so as to control sitting posture.

15. A portable seat apparatus according to claim 9, wherein:

said third support means comprises a pair of spaced-apart lower back support members;

said back support portion further comprises fourth support means for independently supporting two separate portions of a user's back, on either side of the spine, in the thoracic area, said fourth support means comprising a pair of spaced-apart upper back support members; and said upper back support members are arranged in a vertical plane which is closer to the front of said chair than the vertical plane containing said lower back support members.

16. A portable seat apparatus according to claim 15, wherein:

said lower back support members and said upper back support members are each substantially spherical.

17. A portable seat apparatus according to claim 15, wherein:

said lower back support members and said upper back support members are each substantially disc-shaped.

18. A portable seat apparatus according to claim 15, wherein:

the portions of said frame supporting said back support portion are hingedly connected to the portion of said frame supporting said seat portion.

19. A portable seat apparatus according to claim 7, wherein:

said buttocks support members and said thigh support member of said seat portion are each provided with vibration means.

20. A portable seat apparatus according to claim 15, wherein:

said buttocks support members and said thigh support member of said seat portion, and said upper and lower back support members, are each provided with vibration means.

* * * * *